US008935815B2

(12) United States Patent
Marugg

(10) Patent No.: US 8,935,815 B2
(45) Date of Patent: Jan. 20, 2015

(54) OPERATING TABLE

(75) Inventor: Silvio Marugg, Stetten (CH)

(73) Assignee: Berchtold Holding GmbH (DE)

( * ) Notice: Subject to any disclaimer, the term of this patent is extended or adjusted under 35 U.S.C. 154(b) by 28 days.

(21) Appl. No.: 13/248,399

(22) Filed: Sep. 29, 2011

(65) Prior Publication Data

US 2012/0304383 A1 Dec. 6, 2012

(30) Foreign Application Priority Data

Sep. 29, 2010 (DE) ..... 10 2010 046 845

(51) Int. Cl.
*A61G 7/08* (2006.01)
*A61G 13/08* (2006.01)
*A61G 13/10* (2006.01)

(52) U.S. Cl.
CPC ..... *A61G 13/08* (2013.01); *A61G 13/104* (2013.01); *A61G 2203/70* (2013.01)
USPC ..... 5/86.1; 5/600; 280/657

(58) Field of Classification Search
CPC ..... A61G 1/0212; A61G 1/0237; A61G 7/08; A61G 7/1046; A61G 13/104
USPC ..... 5/600, 613, 620, 86.1, 625, 607–611, 5/618; 296/20; 254/8 R; 280/657
See application file for complete search history.

(56) References Cited

U.S. PATENT DOCUMENTS

| | | | | |
|---|---|---|---|---|
| 1,961,119 | A * | 5/1934 | Ettinger | 5/89.1 |
| 6,286,164 | B1 * | 9/2001 | Lamb et al. | 5/600 |
| 6,430,761 | B1 * | 8/2002 | Brandorff et al. | 5/86.1 |
| 6,499,163 | B1 * | 12/2002 | Stensby | 5/618 |
| 6,793,232 | B1 | 9/2004 | Wing | |
| 6,857,144 | B1 * | 2/2005 | Huang | 5/86.1 |
| 8,474,794 | B2 * | 7/2013 | Liljedahl | 254/120 |
| 2002/0095728 | A1 | 7/2002 | Weismiller | |

FOREIGN PATENT DOCUMENTS

| | | | |
|---|---|---|---|
| DE | 1 054 663 | B | 4/1959 |
| DE | 3 805 431 | A1 | 3/1989 |
| DE | 43 09 663 | C1 | 4/1994 |
| DE | 103 52 707 | A1 | 6/2005 |
| DE | 10 2004 040 721 | A1 | 12/2005 |
| DE | 60 2005 004 469 | T2 | 1/2009 |
| EP | 0 790 050 | A2 | 8/1997 |
| EP | 0 790 050 | A3 | 4/1998 |

OTHER PUBLICATIONS

European Search Report in corresponding European Patent Application No. 11007495.2-1257 / 2436357 dated Oct. 16, 2012, 3 pages.
English translation of European Search Report in corresponding European Patent Application No. 11007495.2-1257 / 2436357 dated Oct. 16, 2012, 3 pages.

(Continued)

*Primary Examiner* — Nicholas Polito

(74) *Attorney, Agent, or Firm* — Leech Tishman Fuscaldo & Lampl; Kenneth D'Alessandro

(57) ABSTRACT

An operating table comprises a patient support carried by a column, wherein the column has a foot having at least two base arms which are arranged next to one another and which extend with variable spacing in the longitudinal direction of the patient support.

5 Claims, 2 Drawing Sheets

(56) References Cited

OTHER PUBLICATIONS

German Search Report dated Aug. 1, 2011 in corresponding German Patent Application No. 10 2010 046 845.2 filed Sep. 29, 2010.

English Translation of German Search Report dated Aug. 1, 2011 in corresponding German Patent Application No. 10 2010 046 845.2 filed Sep. 29, 2010.

* cited by examiner

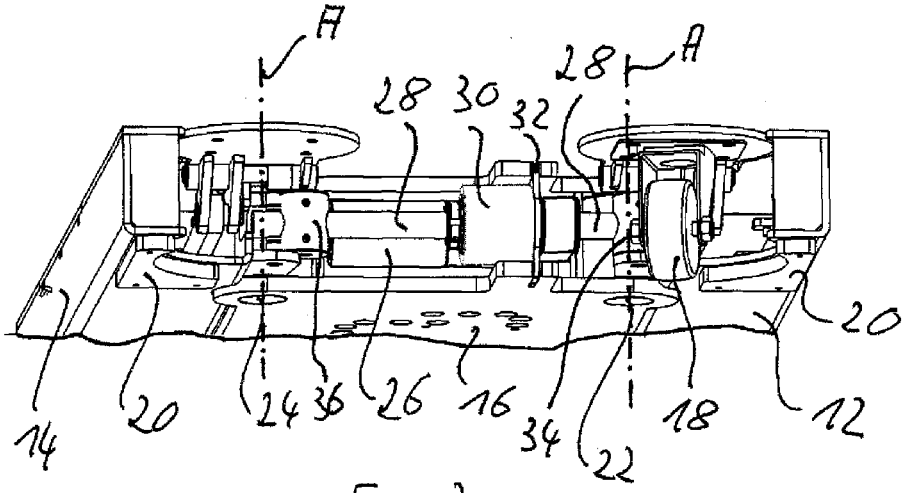
Fig. 3
Fig. 4
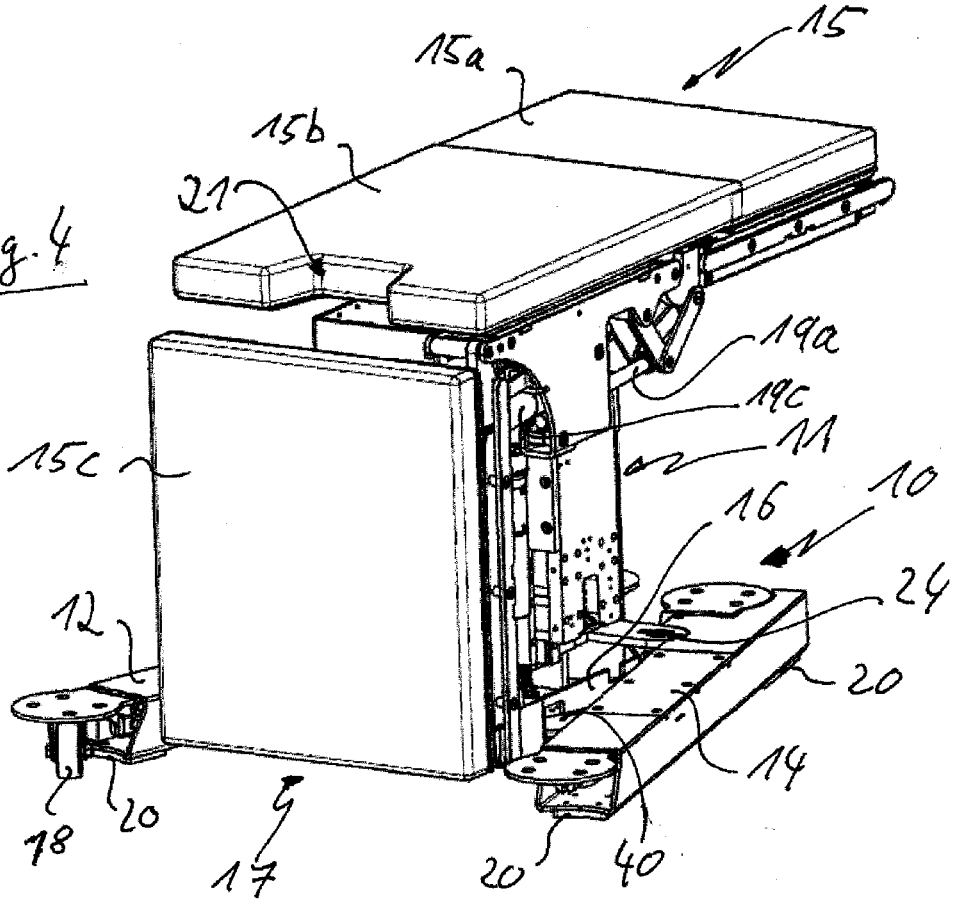

OPERATING TABLE

CROSS-REFERENCE TO RELATED APPLICATIONS

This application claims the priority benefit of German Patent Application Number 10 2010 046 845.2, filed Sep. 29, 2010, the entirety of which is incorporated by reference herein.

BACKGROUND OF THE INVENTION

1. Field of the Invention

The present invention relates to an operating table in accordance with the preamble of claim 1, comprising a patient support carried by a column, wherein the column has a foot having at least two base arms which are arranged next to one another and which extend in the longitudinal direction of the patient support. The base arms are in this respect provided with a foot which can be fixed or adjustable or which can also be made in the form of a castor.

2. The Prior Art

Restricted access to the patient due to the base arms which are present is problematic for some operations with such operating tables. In some operations, for example for gynecological surgery, the folding down of a leg plate of the patient support is furthermore impeded by the base arm. It is the object of the invention to further develop an operating table of the above-named kind such that improved access to the patient is provided.

This object is satisfied by the features of claim 1 and in particular in that the spacing between the base arms can be varied.

BRIEF DESCRIPTION OF THE INVENTION

In accordance with the invention, the base arms are thus not rigidly fastened, but the spacing between the base arms can rather be varied so that the free space between the base arms can be increased at their ends, i.e. at the point at which the feet are fastened. Considerably improved access to the patient is hereby provided and parts of the patient support can be folded down to just above the floor since the base arms are not in the way.

Advantageous embodiments of the invention are described in the description, in the drawings and in the dependent claims. In accordance with a first advantageous embodiment, the base arms can be adjustable such that the spacing between two adjacent outer ends of the base arms is increased. This can be realized, for example, in that the two base arms are pivotably supported. The relative spacing can be varied in a simple manner by pivoting the base arms to obtain the desired free space.

In accordance with a further advantageous embodiment, each base arm can be pivotable about a vertical axis, with a drive for pivoting the base arms being arranged in the region of the pivot axes. A compact arrangement is provided in this embodiment. In accordance with a further advantageous embodiment, the base arms can be adjustable from a substantially parallel position into a position in which they include an acute angle which in particular amounts to approximately 10° to approximately 40°. In this respect, the base arms can be formed as two cross-members which are movable from a mutually parallel position into a spread apart position.

It can be advantageous if the base arms are pivotable by a single spindle so that, for example, a simultaneous pivoting of the two base arms is possible with the aid of an electric motor by driving the spindle. For this purpose, the spindle can have a left-hand thread and a right-hand thread to allow the opposed pivot movement.

It can be advantageous for a good stability if each base arm has a support element which can be moved into a base located between the base arms. A stable support of the operating table is hereby achieved both in the parallel position and in the spread apart position of the support elements.

BRIEF DESCRIPTION OF THE DRAWINGS

The present invention will be described in the following purely by way of example with reference to an advantageous embodiment and to the enclosed drawings. There are shown:

FIG. 3 a perspective rear view of a part of the foot of FIG. 1 and FIG. 2; and FIG. 4 shows a perspective view of an operating table, with different components and cladding parts not being shown for a better illustration.

DETAILED DESCRIPTION

The operating table includes a patient support 15 which has, in the embodiment shown, a total of three support parts 15*a*, 15*b* and 15*c* which can be arranged in a row to form a lying surface. The patient support 15 is mounted in a manner known per se on a column 11 which is in turn carried by a foot 10 which will be described in more detail in connection with FIG. 1 to FIG. 3.

Figure 1:
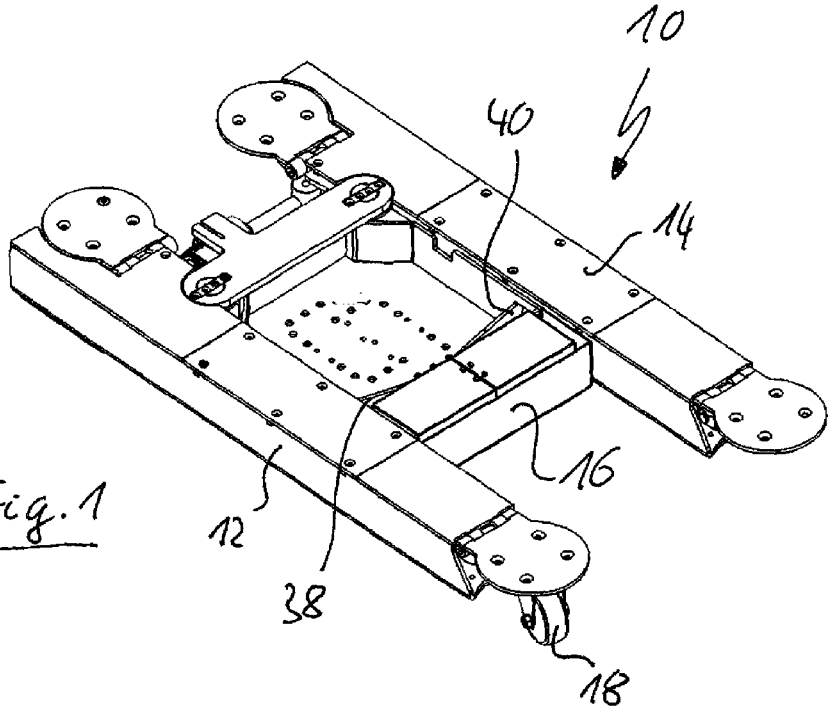
FIG. 1 a perspective view of a foot of an operating table with two base arms in a parallel position.
Figure 2:
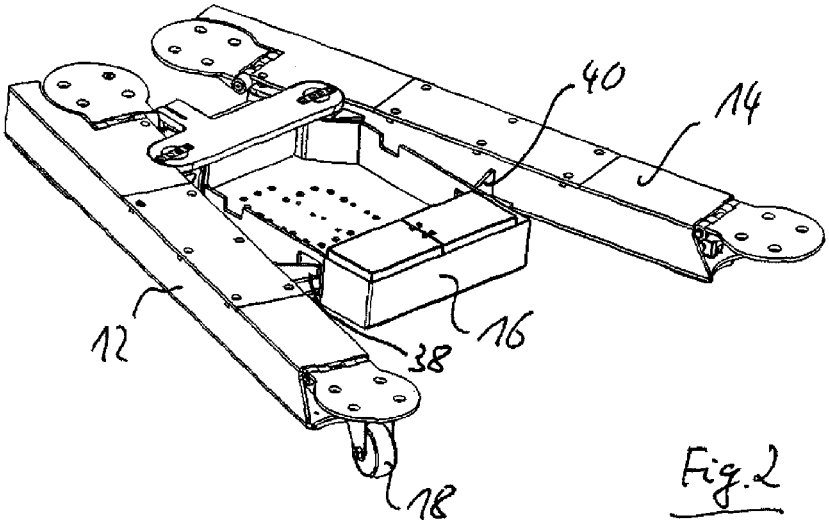
FIG. 2 the foot of FIG. 1 with the base arms in the spread apart position.

The foot 10 shown in FIGS. 1 to 3 has, in the embodiment shown, a total of two base arms 12 and 14 which are arranged mutually parallel and are fastened to a foot well 16. A foldable castor 18 is arranged at each of the four ends of the two base arms 12 and 14, with only one of the castors 18 being shown in the Figures. The castors 18 are formed in a manner known per se as castor wheels and can be folded down for a transport of the table. After a raising of the castors, the foot stands on four supports 20 of which only two can be recognized in FIG. 3.

In FIG. 1, the two base arms 12 and 14, which are formed as hollow crossmembers, are shown in their parallel position in which they extend parallel to one another. The two base arms are pivotable out of this parallel position into a spread apart position shown in FIG. 2. For this purpose, the two base arms 12 and 14 are pivotally connected via a bolt 22 and 24 respectively (cf. FIG. 3) to the foot well 16 so that each base arm 12 and 14 is pivotable about a vertical axis A from the parallel position into the spread apart position. In this respect, the bolts 22 and 24 form the vertical pivot axis A for the base arms. The spacing between the base arms and in particular between the outer ends of the two base arms 12 and 14 is hereby variable. When the two base arms are moved from the parallel position into the spread apart position, the available space 17 (cf. FIG. 4) between the two base arms 12 and 14 is increased.

The most varied drive means are conceivable for a movement of the two base arms. For example, pneumatic, hydraulic or electric drives can be used for this purpose. In the embodiment shown, a single drive is provided for the pivoting of the two base arms 12 and 14 which is arranged in the region of the pivot axes A which are formed by the two bolts 22 and 24. As FIG. 3 illustrates, the drive includes an electric motor 26 which drives a spindle 28 which is provided with a right-hand thread at one end and with a left-hand thread at the other end. In addition, a bearing 30 which is held via a vertical assembly plate 32 in slits of the foot well 16 is provided at the spindle 28. An additional stabilization of the spindle 28 is hereby achieved which cooperates at its two ends with a spindle nut 34 and 36 respectively. Both spindle nuts 34 and 36 are pivotably supported about a vertical pivot axis at a base arm 12 and 14 respectively. In this manner, the spindle 28 can be set into rotation by actuating the electric motor 26, whereby the two spindle nuts 34 and 36 move toward or away from one another, which in turn has the effect that the two base arms 12 and 14 move into their spread apart position (FIG. 2) or into their parallel position (FIG. 1).

So that a stable position of the operating table is ensured both in the parallel position and in the spread apart position, each base arm 12 and 14 has a support element 38, 40 which extends into the foot well 16 and which extends through an opening provided in the foot well.

In the embodiment shown, the central support part 15*b*, which is arranged above the column 11, is approximately of exactly the same size as the support part 15*c* and the support part 15*a* forming a head part is approximately half the size of the two support parts 15*b* and 15*c*. The support part 15*a* can be folded downwardly via a positioning cylinder 19*a*.

In the same way, the support part 15*c* can be folded down via a positioning cylinder 19*c* into the vertical position shown in FIG. 4. As FIG. 4 illustrates, the two base arms 12 and 14 are moved so far apart at their outer ends in the spread apart position that the space 17 between the two base arms 12 and 14 makes it possible that the support part 15*c* can be folded down into the space 17 between the two base arms.

Although a comparatively long foot support part 15*c* is therefore provided which has approximately the same longitudinal extent as the central support part 15*b*, the foot support part 15*c* can be folded completely into the vertical so that it does not impeded the surgeon.

As FIG. 4 further shows, the central support part 15*b* has at its end face facing the foldable support part 15*c* a central cut-out 21 which provides the surgeon with additional free space, in particular for gynecological operations.

The invention claimed is:

1. An operating table, comprising a patient support carried by a column, wherein the column has a foot having a total of two base arms which are arranged next to one another and each pivotally connected at a pivot point to a base having two parallel sides and located between the base arms, the pivot point defining a long segment and a short segment of each base arm, the base arms extending in the longitudinal direction of the patient support, a castor being arranged at each of four ends of the two base arms, wherein the spacing between the base anus is variable and wherein the base arms are movable out of a mutually parallel position, in which position the base arms lie against the two parallel sides of the base, into a spread apart position, in which position each base arm includes an acute angle with the adjacent side of the base, and a support element extending inwardly towards the base from the long segment of each base arm and movable into apertures formed in the base.

2. The operating table in accordance with claim 1, wherein each base arm is pivotable about a vertical axis; and wherein a drive for pivoting the base arms is arranged in the region of the pivot axes.

3. The operating table in accordance with claim 1, wherein the base arms are adjustable out of a substantially parallel position into a position in which they include in the spread apart position an acute angle which in particular amounts to approximately 10° to approximately 40°.

4. The operating table in accordance with claim 1, wherein the base arms are pivotable by a single spindle.

5. The operating table in accordance with claim 1, wherein the patient support has a support part which can be folded down into the space between two base arms.

* * * * *